United States Patent [19]

Sun

[11] Patent Number: 5,014,437

[45] Date of Patent: May 14, 1991

[54] STRUCTURE OF AN INK CUP

[76] Inventor: Fu-Cheng Sun, No. 126, Pao Chung Road, Hsin Tien, Taipei Hsien, Taiwan

[21] Appl. No.: 480,150

[22] Filed: Feb. 14, 1990

[51] Int. Cl.[5] ..... B44D 3/38

[52] U.S. Cl. ..... 33/414; 33/756; 33/761; 242/84.8

[58] Field of Search ..... 33/413, 414, 756, 761; 242/84.8, 107.6

[56] References Cited

U.S. PATENT DOCUMENTS

| | | | |
|---|---|---|---|
| 712,283 | 11/1902 | Filson | 33/414 |
| 1,272,270 | 5/1918 | Järviö | 33/414 |
| 1,945,842 | 2/1934 | Witchger | 242/107.6 |
| 2,398,805 | 4/1946 | Pomeroy | 33/414 |
| 4,121,785 | 10/1978 | Quenot | 242/84.8 |
| 4,192,078 | 3/1980 | Lore et al. | 33/414 |
| 4,197,656 | 4/1980 | Lane et al. | 33/414 |
| 4,443,944 | 4/1984 | Beesley | 33/761 |
| 4,565,011 | 1/1986 | Karger | 33/414 |
| 4,592,148 | 6/1986 | Longenette | 33/414 |
| 4,730,783 | 3/1988 | Lamson | 33/761 |
| 4,765,557 | 8/1988 | Kahmann | 33/414 |
| 4,773,162 | 9/1988 | Lin | 33/756 |
| 4,813,145 | 3/1989 | Jasey, Jr. et al. | 33/756 |
| 4,926,562 | 5/1990 | Hwu | 33/414 |

FOREIGN PATENT DOCUMENTS

| | | | |
|---|---|---|---|
| 0592053 | 2/1960 | Canada | 33/756 |
| 136993 | 12/1929 | Switzerland | 33/414 |

*Primary Examiner*—William A. Cuchlinski, Jr.
*Assistant Examiner*—Alvin Wirthlin
*Attorney, Agent, or Firm*—Bacon & Thomas

[57] ABSTRACT

The invention relates to the improved structure for an ink cup, particularly such structure having upper and lower cover bodies, a thread winding wheel, a manual turning wheel and an inverted T-shaped pressing disk. The interior of the inverted T pressing disk encloses a compression spring and is set inside the manual turning wheel by means of a hollow circular rod. The manual turning wheel cooperates with a circular hole in the upper cover body, and is urged into contact with the upper cover body by the compression spring in the pressing disk. A spiral spring in the thread winding wheel automatically rewinds the thread except when the manual turning wheel is squeezed against the cover body to stop the thread winding wheel.

2 Claims, 2 Drawing Sheets

FIG • 1

STRUCTURE OF AN INK CUP

BACKGROUND OF THE INVENTION

This invention relates to the improved structure of an ink cup, particularly such an ink cup having manual and auto thread rewinding and a thread winding wheel automatic braking function.

An ink cup is one of the most basic tools, having used for construction in ancient China. It is involved in all areas such as measuring, positioning and regulating construction work prior to the digging of the foundation at a construction site. With the application of an ink cup, civil engineers are able to acquire the correct information pertaining to measurements required for the construction work. Generally speaking, the ink cup which is most commonly used is one in which the thread winding wheel is directly located over the ink disk, and in which thread will pass through the ink absorbing object before it comes out of the winding wheel. At the time of application, one person will control the ink cup, and the fixed pin at the end of the thread will be fixed on a certain fixed point. The person will then pull up the thread and let it spring back onto the ground or other surface to thus produce a mark made by the ink which is on the thread. In spite of the fact that such an ink cup is, of course, gifted with the effect of practicality, it is apt to be easily overturned which results in the ground or other surface being stained with ink because: the ink disk is not in a sealed container, the installation of a fixed thread winding wheel; and the auto rewinding installation. Other defects exist, such as the necessity for the person who controls the ink cup to cooperate with the person who pulls the thread in fixing the thread winding wheel and the requirement for him to manually re-wind the thread after the marking process has been completed. Thus, the known ink cups are inconvenient and time consuming at the time of application, making improvement quite necessary.

SUMMARY OF THE INVENTION

The object of this invention is to provide an improved structure for an ink cup which features automatically fixing the thread winding wheel and an auto thread rewinding, so as to enhance its practical effect and achieve convenient application.

The improved ink cup has a structure which comprises: upper and lower cover bodies; a thread winding wheel; a manual turning wheel; and an inverted T-shaped pressing disk. The interior of the inverted T-shaped pressing disk houses a compression spring and is set inside the manual turning wheel by means of a hollow circular rod. The manual turning wheel cooperates with a circular hole of the upper cover body, and the thread winding wheel passes through, and is connected onto an elongated fixing shaft extending from the lower cover body. The compression spring extends between the pressing disk and an elongated shaft. A spiral spring is located in the thread winding wheel, so that a rewinding movement can be automatically produced when the pulling of the thread causes the thread winding wheel to tighten the spiral spring. When the pressing disk is elevated by the compression spring it urges the manual turning wheel against the cover body to brake the thread winding wheel.

For the purpose of providing a better understanding to the technical measures and effect adopted by this invention as a means of achieving the preceedingly mentioned objects, a preferred embodiments coping with the related drawings are described herein for the reference of the Examiners.

DETAILED DESCRIPTION OF THE PREFERRED EMBODIMENT

Figure 1:
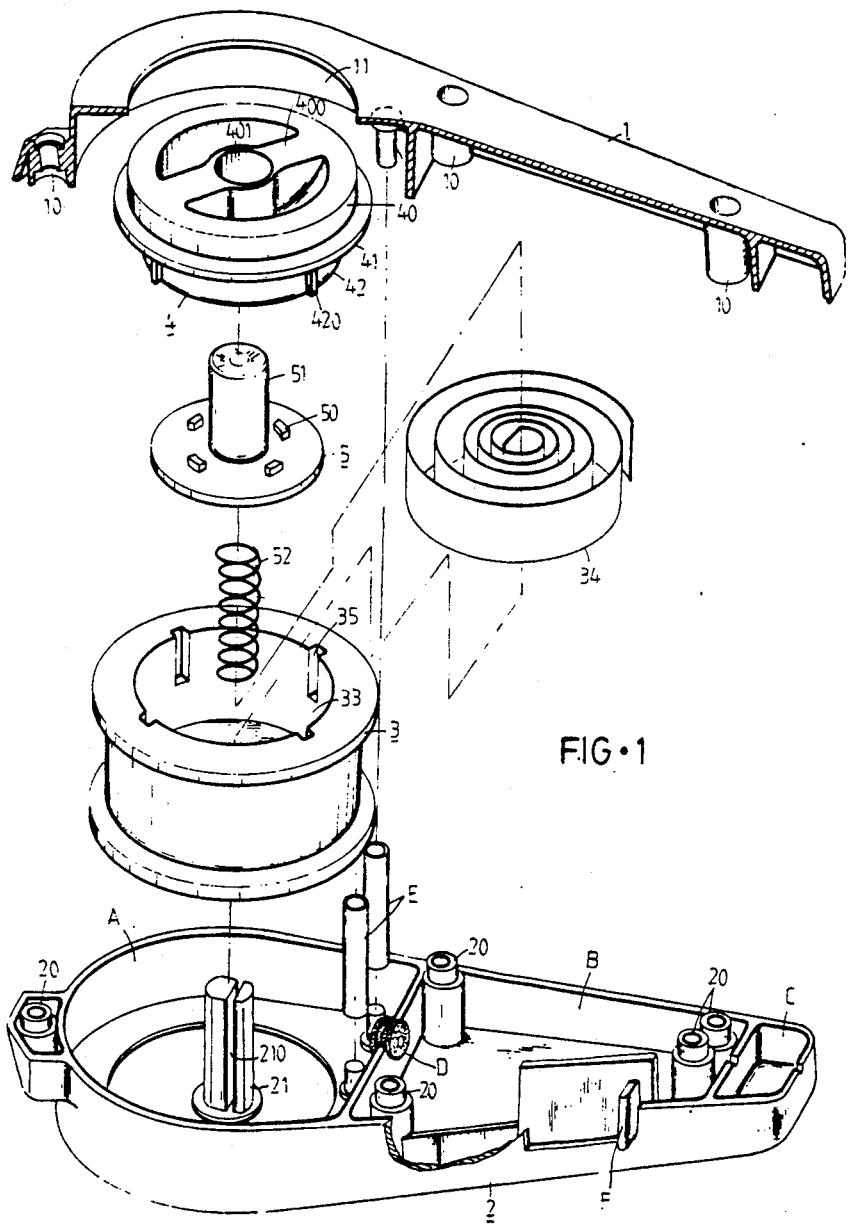
FIG. 1 is an exploded, perspective view of an ink cup according to the present invention.
Figure 2:
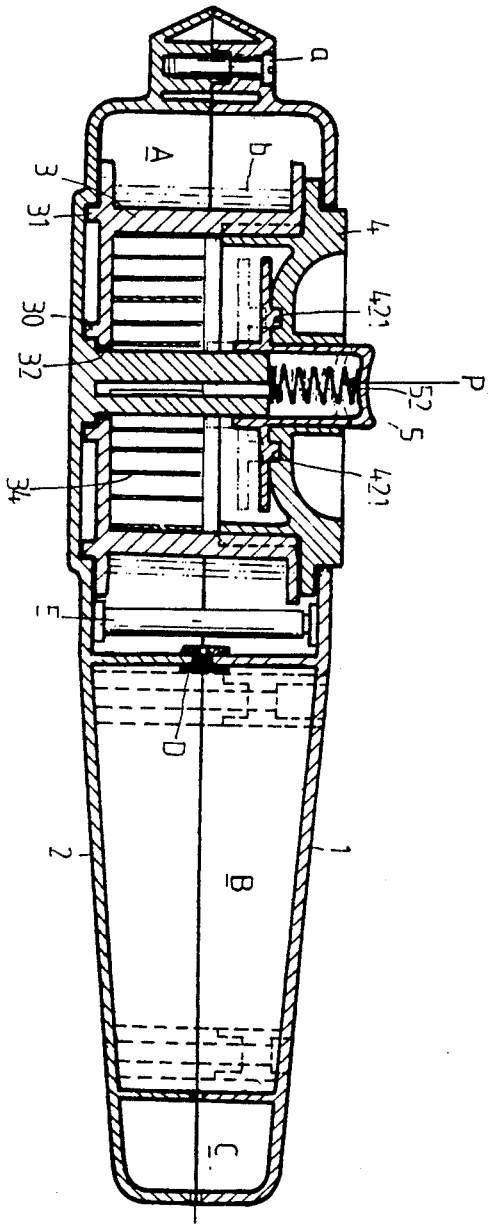
FIG. 2 is a cross-sectional view of the device shown in FIG. 1.

As illustrated in FIGS. 1 and 2, the assembly of this invention comprises upper and lower cover bodies 1 and 2, a threading winding wheel 3, a pressing disk 5 and a manual turning wheel 4. The upper and lower cover bodies 1 and 2 are correspondingly connected together to form a generally rectangular cover having one end large and the other end small. The cover bodies are connected by means of the coordination of a female boss 10 and male boss 20, through which extends a screw a. Its interior is divided into a thread winding chamber A, an ink suctioned object chamber B and a staining chamber C. At the central position of a partitioned plate which lies in between the thread winding wheel chamber A and the ink suctioned object chamber B and I-shaped staining object D is sleeved. At the same time, two rollers E are set in the interior of the thread winding wheel chamber A adjacent to the location of the I-shaped staining object D. A sliding plate switch F is set at the position to allow access to chamber B and the thread b. A circular hole 11 is defined by and is located at the thread winding wheel chamber A of the upper cover body 1. An elongated fixed shaft 21 having a slot 210 projects from the lower cover body 2 and is centrally located in thread winding wheel chamber A.

The thread winding wheel 3 is a generally I-shaped cylindrical wheel having inner and outer concentric rings 30 and 31 at its bottom plane, which cooperate with the lower cover body 2 in the winding wheel chamber A to support the wheel 3. The center of the bottom plane defines a circular hole 32 which is larger than the largest diameter of the elongated fixed shaft 21. A spiral spring 34 is located in a lower part of the interior 33 of the wheel 3 such that the inner end engages slot 210 as shown in FIG. 2. Cooperating with the strips 420 extending from manual turning wheel 4, a plurality of grooves 35 are located on the upper half wall defining the interior 33 of wheel 3. After the thread b has been wound on the thread winding wheel 3, it is placed inside the thread winding wheel chamber A of the upper/lower cover bodies 1 and 2 such that circular hole 32 is engaged by the elongated fixed shaft 21. The inner end of the spiral spring 34 is inserted into the groove 210. After the thread has been drawn from the wheel 3, the thread winding wheel 3 will be able to spring back because of its springing force, so as to further achieve the object of automatically reeling back the thread b.

The manual turning wheel 4 defines upper, middle and lower cylindrical surfaces 40, 41 and 42 of unequal diameter, of which the upper surface corresponds to the dimension of the circular hole 11 of the upper cover body 1. A handle 400, which is defined between two semi-circular arc grooves, has a circular hole 401 located at its central position. A lower cylindrical surface 42 is located below the middle surface 41, and fits into the interior 33 of the thread winding wheel 3 such that strips 420 fit into grooves 35. Concave grooves 421 are defined in the lower portion of turning wheel 4 arranged in a radial array. When the circular hole 11 is engaged by the upper cylindrical surface 40, the strips 420 will be engaged with the grooves 35 of the thread winding wheel 3 by pushing them together.

The pressing disk 5 has a generally inverted T shape. Blocks 50 extend from the plane of the bottom disk to cooperate with the concave grooves 421 defined in the turning wheel 4. Its central circular rod 51 is a hollow cylindrical body, with its top plane made to form a concave, shaped touching/pressing area. The interior end of the hollow cylinder is square in shape to engage compression spring 52. By means of the insertion of the cylindrical rod 51 through the hole 401 in the handle 400, it is arranged to be set inside the lower cylindrical surface 42 of the manual turning wheel 4. Because the bottom of the compression spring 52 bears against the top of elongated shaft 21, the pressing disk 5 will be automatically moved upward to contact the lower portion of the manual turning wheel 4. The blocks 50 will thus be engaged with the concave grooves 421 formed in manual turning wheel 4. It is so designed that, when the ink cup is under a normal condition, the manual turning wheel 4 will be urged against the upper body cover 1 by the pressing disk 5 and spring 52, so as to control the thread winding wheel 3. As indicated by the imaginary line in FIG. 2, when the pressing disk 5 is pressed downward, the convex blocks 50 on the pressing disk 5 will be disengaged from the concave grooves 421. At this time, because of the absence of resistance on the manual turning wheel 4, the thread winding wheel 3 will thus be able to revolve, and it may be operated in such a way that the thread b will either be pulled out or reeled back. However, when the pressure on the pressing disk 5 is released, the pressing disk 5 will be urged upwardly by compression spring 52, into contact with the lower portion 42. By the time when the convex blocks 50 engage the concave grooves 421, it will automatically stop the thread winding wheel 3 from revolving, and consequently stop the thread b from being pulled out or reeled back. When the thread winding wheel 3 is having the thread reeled back, the thread b will have to pass through the I-shaped staining object D for a compact cleaning process. The volume of ink contained by the thread which is reeled back on the thread winding wheel 3 will be reduced.

Summarizing the above-mentioned description, the structure disclosed by the preferred embodiments of this invention is found to be of an effective practicality. The structure not only has an auto thread reeling back function, but is also gifted with the function of preventing the thread winding wheel 3 from revolving. Furthermore, it also proved to be capable of being operated freely.

What is claimed is:

1. An ink cup for a striking line comprising:

(a) upper and lower cover bodies having partitions such that, when the cover bodies are attached together they define separate winding wheel, ink suction object and staining chambers;

(b) attaching means to attach the upper and lower cover bodies together;

(c) a thread winding wheel rotatably located in the winding wheel chamber, the thread winding wheel having a handle exteriorly of one of the upper and lower cover bodies to permit manual rotation of the thread winding wheel;

(d) a striking line thread wound on the thread winding wheel and extending through the ink suction object chamber and the staining chamber to the exterior of the cover bodies;

(e) an elongated fixed shaft extending into the winding wheel chamber from one of the upper and lower cover bodies so as to rotatably locate the thread winding wheel in the winding wheel chamber;

(f) a pressing disk member having a disk portion located within the winding wheel and a rod portion extending through the winding wheel handle to the exterior of the cover bodies; and (g) spring biasing means acting on the pressing disk member to urge the disk portion into contact with the handle and to urge the handle into contact with one of the cover bodies.

2. The ink cup of claim 1 further comprising:

(a) a plurality of blocks extending from the disk portion of the pressing disk member; and, (b) a corresponding number of concave grooves defined by the handle and located such that they are engaged by the plurality of blocks when the disk portion is in contact with the handle.

* * * * *